US005752368A

United States Patent [19]

Tobe

[11] Patent Number: 5,752,368

[45] Date of Patent: May 19, 1998

[54] MEDICATION FILLING APPARATUS

[75] Inventor: Ryuzo Tobe, Maebashi, Japan

[73] Assignee: Sanyo Electric Co., Ltd., Osaka, Japan

[21] Appl. No.: 706,985

[22] Filed: Aug. 23, 1996

[30] Foreign Application Priority Data

Aug. 23, 1995 [JP] Japan ..... 7-237602

[51] Int. Cl.[6] ..... B65G 47/44; B65B 57/20

[52] U.S. Cl. ..... 53/501; 53/237; 53/238; 364/479.14; 221/3

[58] Field of Search ..... 364/478.04, 479.12, 364/479.13, 479.14; 221/2, 3, 1, 7, 123, 8; 53/25, 154, 155, 237, 238, 168, 268, 473, 493, 500, 501

[56] References Cited

U.S. PATENT DOCUMENTS

| | | | |
|---|---|---|---|
| 3,473,287 | 10/1969 | Littwin | 53/501 |
| 3,530,639 | 9/1970 | Bross | 53/501 |
| 3,871,156 | 3/1975 | Koenig et al. | 53/268 |
| 4,013,192 | 3/1977 | Pillon | 53/501 |
| 4,071,998 | 2/1978 | Meadows | 53/501 |
| 4,572,403 | 2/1986 | Benaroya | 364/479.14 |
| 4,695,954 | 9/1987 | Rose et al. | 364/479.14 |
| 5,014,875 | 5/1991 | McLaughlin et al. | 364/479.13 |
| 5,481,855 | 1/1996 | Yuyama | 53/237 |
| 5,502,944 | 4/1996 | Kraft et al. | 364/479.12 |

*Primary Examiner*—W. Donald Bray
*Attorney, Agent, or Firm*—Darby & Darby

[57] ABSTRACT

A medication filling apparatus which is capable of preventing medications from being over-dispensed so as to enable accurate filling operation. The medication filling apparatus is equipped with: a tablet case for holding medications; a dispenser drum for dispensing the medications one at a time from the tablet case as it rotates; a motor for driving and rotating the dispenser drum; a sensor for detecting the medications which have been dispensed; and a controller which starts the motor, counts the dispensed medications according to an output of the sensor, and stops the motor when a predetermined count value is reached. The controller drops the voltage applied to the motor before the predetermined count value is reached and then short-circuits the terminals of the motor when the predetermined count value is reached.

4 Claims, 13 Drawing Sheets

MEDICATION FILLING APPARATUS

BACKGROUND OF THE INVENTION

1. Field of the Invention

The present invention relates to a medication filling apparatus for filling a container such as a vial, bag, or packaging paper with medications (the medications hereinafter mean tablets, capsules, pills, lozenges, and any other solid medications) specified by a prescription at a hospital or the like.

2. Description of the Related Art

Conventionally, at a hospital or the like, a plurality of types of tablets or medications prescribed by a doctor are packaged by dividing them for each dose by using a tablet packaging machine disclosed, for example, in Japanese Patent Publication No. 3-59 (A61J3/00) before supplying them to a patient. In some cases, prescribed tablets are placed in containers such as vials or bags by each type of tablets before they are handed to a patient.

In such a machine, the medications charged in a tablet case are dispensed one by one as a dispenser drum rotates, the dispensed medications are counted according to the outputs of a sensor which detects the dispensed medications, and a motor for driving the dispenser drum is stopped when a predetermined count value is reached. This means that the motor is driven by applying a predetermined voltage thereto to maintain a constant rotational speed of the dispenser drum until the predetermined count value is reached; then as soon as the predetermined count value is reached, the application of the voltage to the motor is stopped.

The dispenser drum, however, cannot stop immediately when the application of the voltage to the motor, which drives the dispenser drum, is stopped. Therefore, the dispenser drum overruns, posing a problem in that the number of actually dispensed medications exceeds the aforesaid predetermined count value in some cases.

Especially when the rotational speed of the dispenser drum is increased in an attempt to shorten the time required for charging the medications, the chances of the over-dispensing caused by the overrun increase.

SUMMARY OF THE INVENTION

The present invention has been made to solve the technical problem with the prior art described above and it is an object of the invention to provide a medication filling apparatus which is capable of preventing over-dispensing of medications so as to assure accurate filling operation.

To this end, according to the present invention, there is provided a medication filling apparatus which includes: a tablet case for holding medications; a dispenser drum for dispensing the medications one at a time from the tablet case as it rotates; a motor for driving and rotating the dispenser drum; a sensor for detecting the medications which have been dispensed; and a controller which starts the motor, counts the dispensed medications according to an output of the sensor, and stops the motor when a predetermined count value is reached. The controller drops the voltage applied to the motor at a value before reaching the predetermined count value.

In addition to dropping the voltage applied to the motor at the value before reaching the predetermined count value, the controller short-circuits a motor terminal when the predetermined count value is reached.

DETAILED DESCRIPTION OF THE PREFERRED EMBODIMENT

Figure 1:
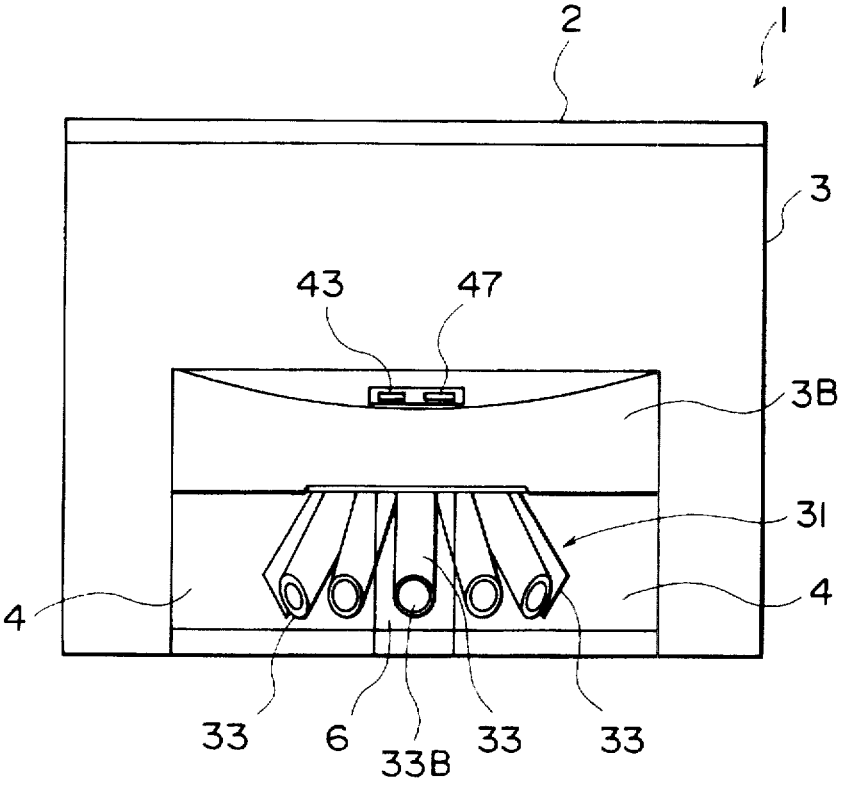
FIG. 1 is a front view showing a medication filling apparatus in accordance with the present invention.
Figure 2:
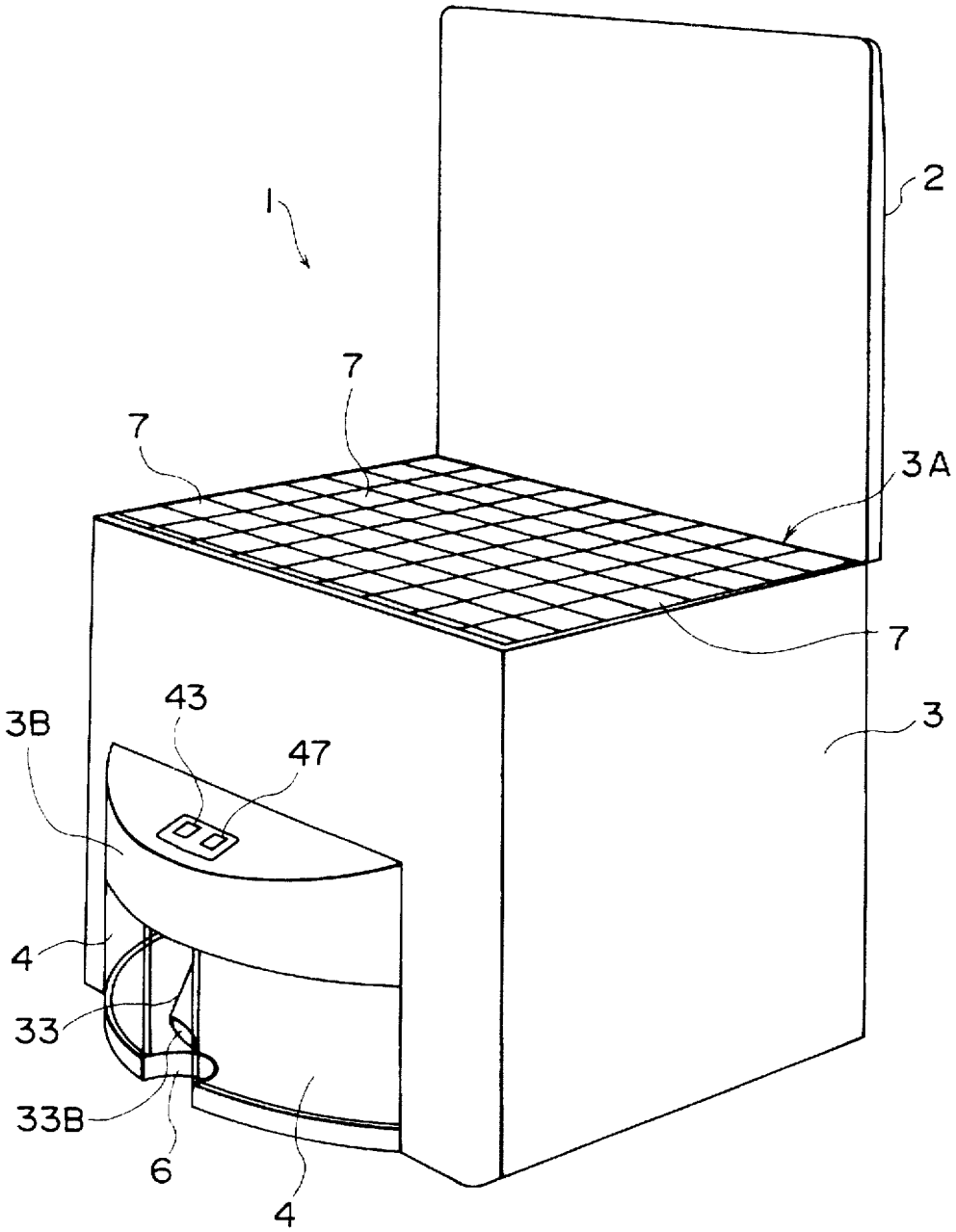
FIG. 2 is a perspective view showing a top table of the medication filling apparatus in accordance with the present invention, the top table being in an opened state.
Figure 3:
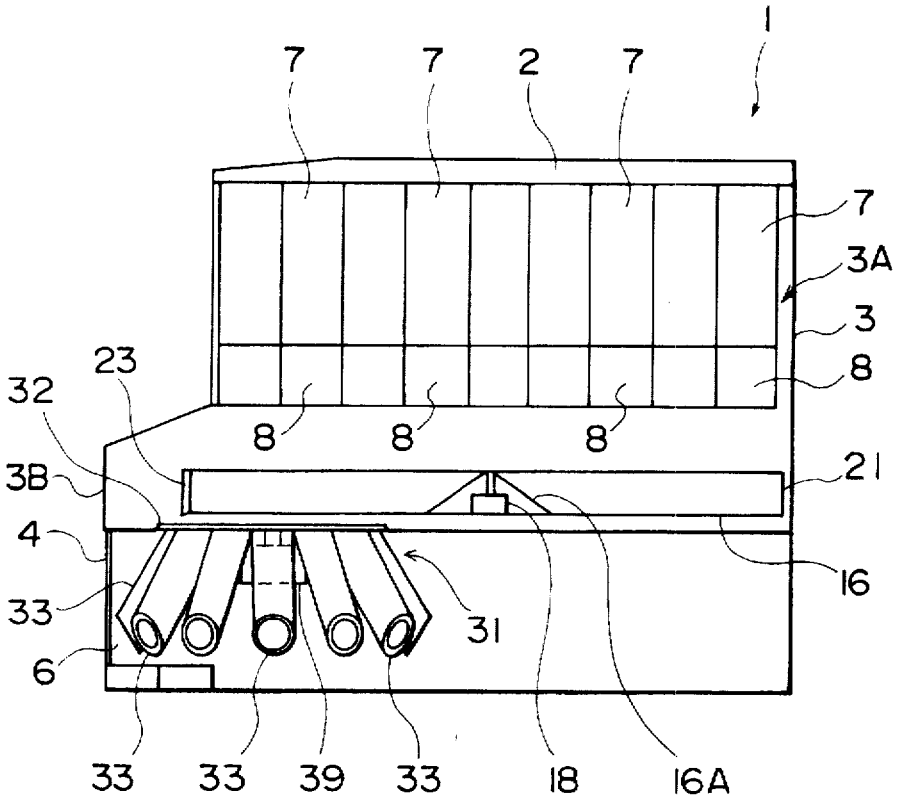
FIG. 3 is a longitudinal sectional side view showing the medication filling apparatus in accordance with the present invention.
Figure 4:
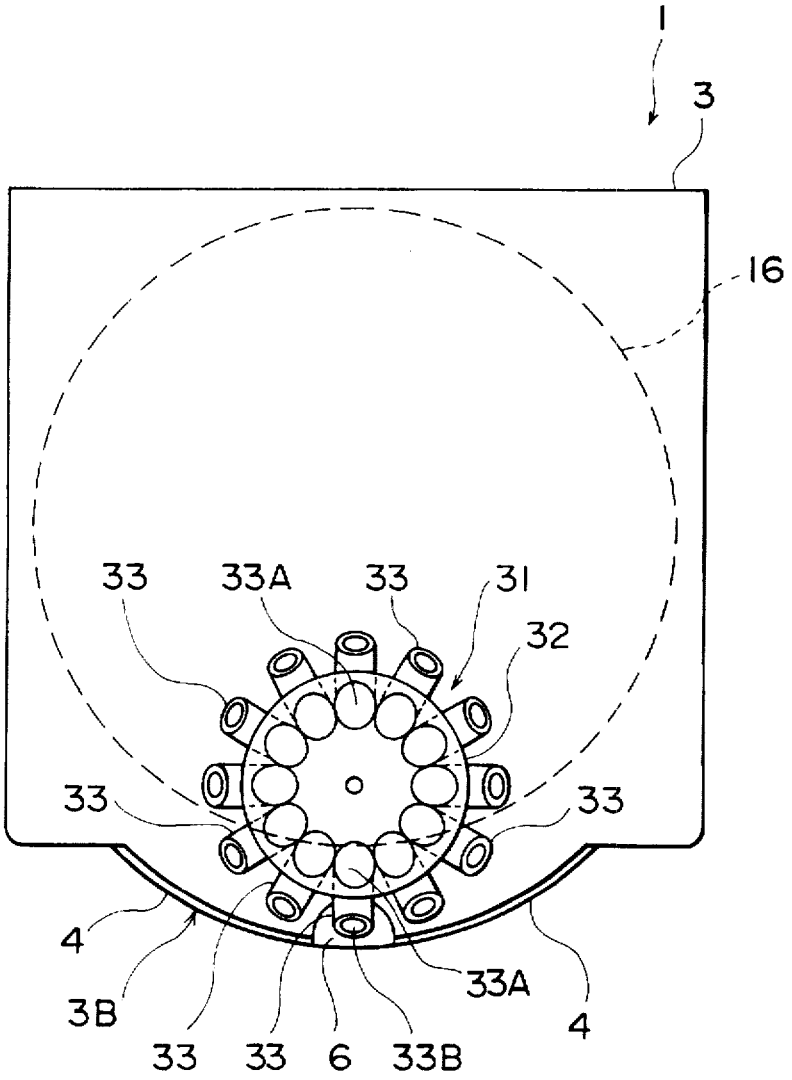
FIG. 4 is a top sectional view showing the medication filling apparatus in accordance with the present invention.

An embodiment of the present invention will now be described in detail with reference to the accompanying drawings.

A medication filling apparatus 1 according to the present invention is intended to be installed at a hospital, pharmacy, or the like. A tablet case assembly 3A is disposed at the top inside a rectangular outer case 3; the tablet case assembly 3A is open upward and provided with a top table 2 which opens and closes the tablet case assembly 3A. A filling section 3B, which has an arc-shaped section, projects at the front of the outer case 3. Transparent glass panels (or acrylic panels or the like) 4, 4, which have arc-shaped sections, are installed on both sides on the front surface of the filling section 3B and an inserting opening 6 which is communicated with the filling section 3B is provided between the transparent glass panels 4, 4.

Figure 8:
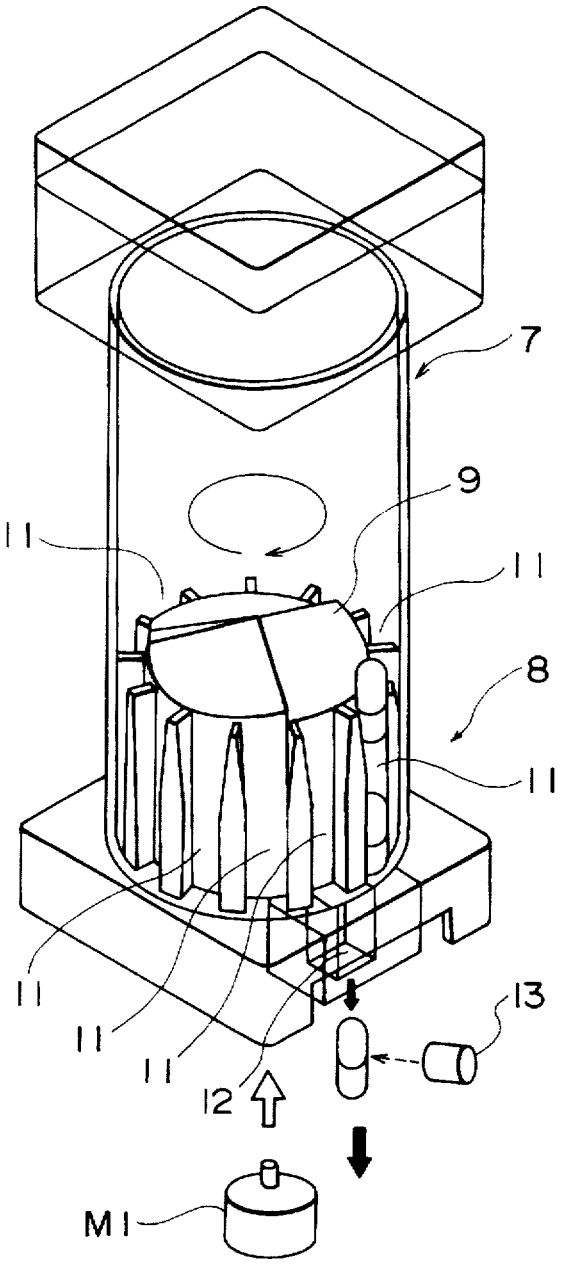
FIG. 8 is a perspective view showing a tablet case and a dispensing and counting device.

A plurality of tablet cases 7 are arranged and housed in the tablet case assembly 3A. The individual tablet cases 7 contain predetermined quantities of medications separately by type; dispensing and counting devices 8 are provided beneath the tablet cases 7 as shown in FIG. 8.

The dispensing and counting devices 8 are respectively communicated with the tablet cases 7 located over them, a motor-driven dispenser drum 9 driven by a motor M1 being incorporated therein. A plurality of vertical grooves 11 are formed from the top to bottom on the side surface of the dispenser drum 9, so that solid medications such as tablets, capsules, pills, and lozenges (two pieces in this embodiment) are vertically aligned in each of these grooves. As the dispenser drum 9 rotates, the medications in each groove 11 drop one by one through an outlet 12 (as indicated by black arrows in FIG. 5 and FIG. 8). The dispensing and counting device 8 is further provided with a photosensor 13 for detecting the medication which has dropped out through the outlet 12.

A turntable 16 is provided in the outer case 3 under the tablet cases 7 and the dispensing and counting devices 8. The turntable 16 is shaped like a disc and has an area which is sufficiently large to match the bottom area of all the tablet cases 7 and the dispensing and counting devices 8. The turntable 16 has a projecting cone 16A at the center thereof; there are also provided partitioning vanes 17, 17 which extend in the radial direction from the projecting cone 16A. A turntable motor 18 drives and rotates the turntable 16 in the direction of the arrows given in the drawing at a predetermined angular velocity.

An annular guide 21 is provided vertically around the turntable 16; a notch-shaped dispensing port 22 is provided at the front end of the guide 21 to communicate the turntable 16 with the area outside the guide 21. The dispensing port 22 is opened and closed by a shutter 23 which swings outward. The shutter 23 is driven by a shutter activating means 24 for a solenoid plunger or the like which will be discussed hereinafter. The vertical dimension of the turntable 16 including the guide 21 is approximately 10 cm.

Figure 6:
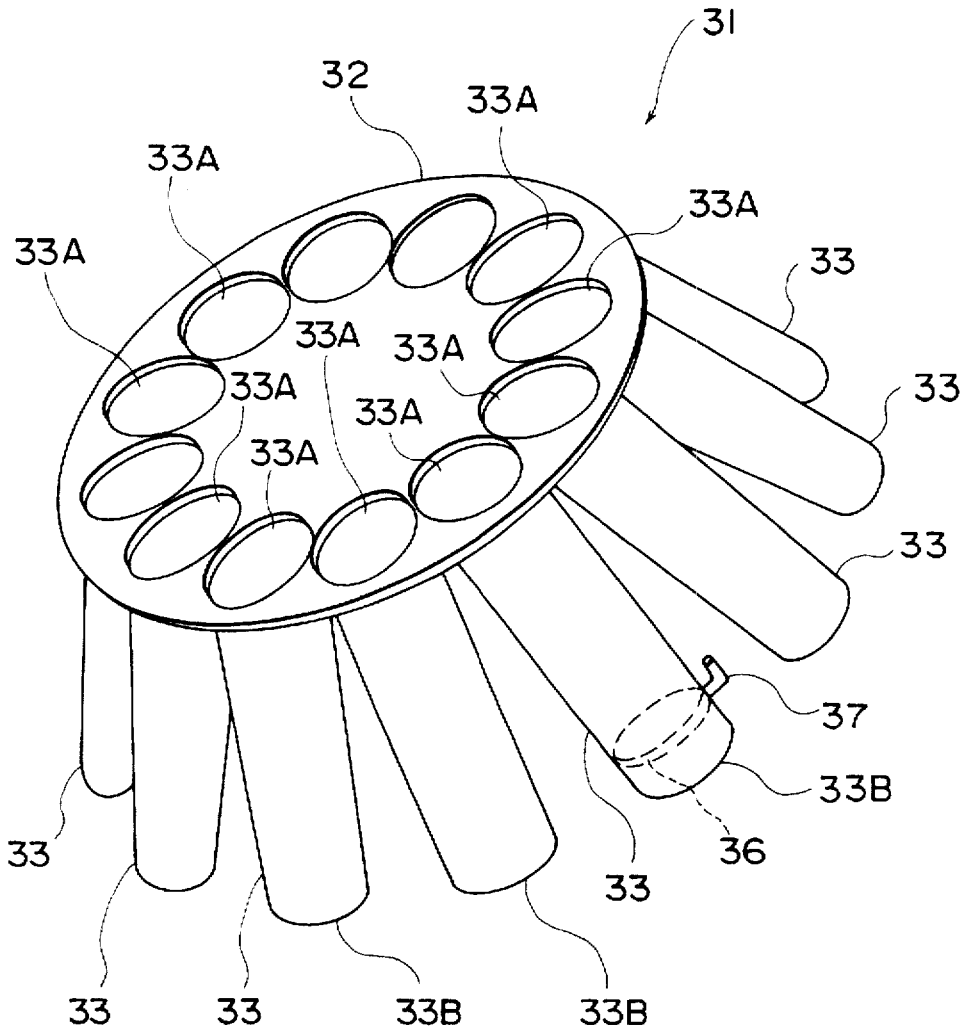
FIG. 6 is a perspective view showing a holder unit.
Figure 7:
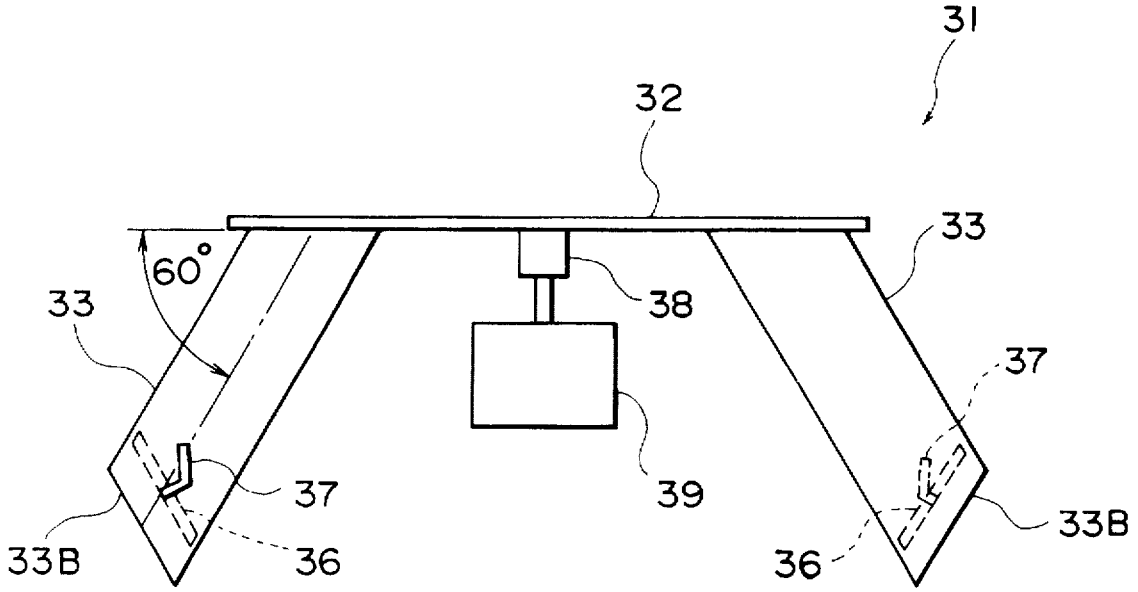
FIG. 7 is a side view showing the holder unit.

Provided at the bottom front of the turntable 16 and the guide 21 is a holder unit 31. As shown in FIG. 6 and FIG. 7, the holder unit 31 is equipped with a disc base 32 at the top and a plurality of holders 33 (12 holders in the embodiment) which jut out from the base 32 and move down aslant (at 60 degrees in the embodiment). The top ends of the respective holders 33 are open through inlets 33A provided in the base 32; the bottom ends thereof are open through outlets 33B.

Figure 5:
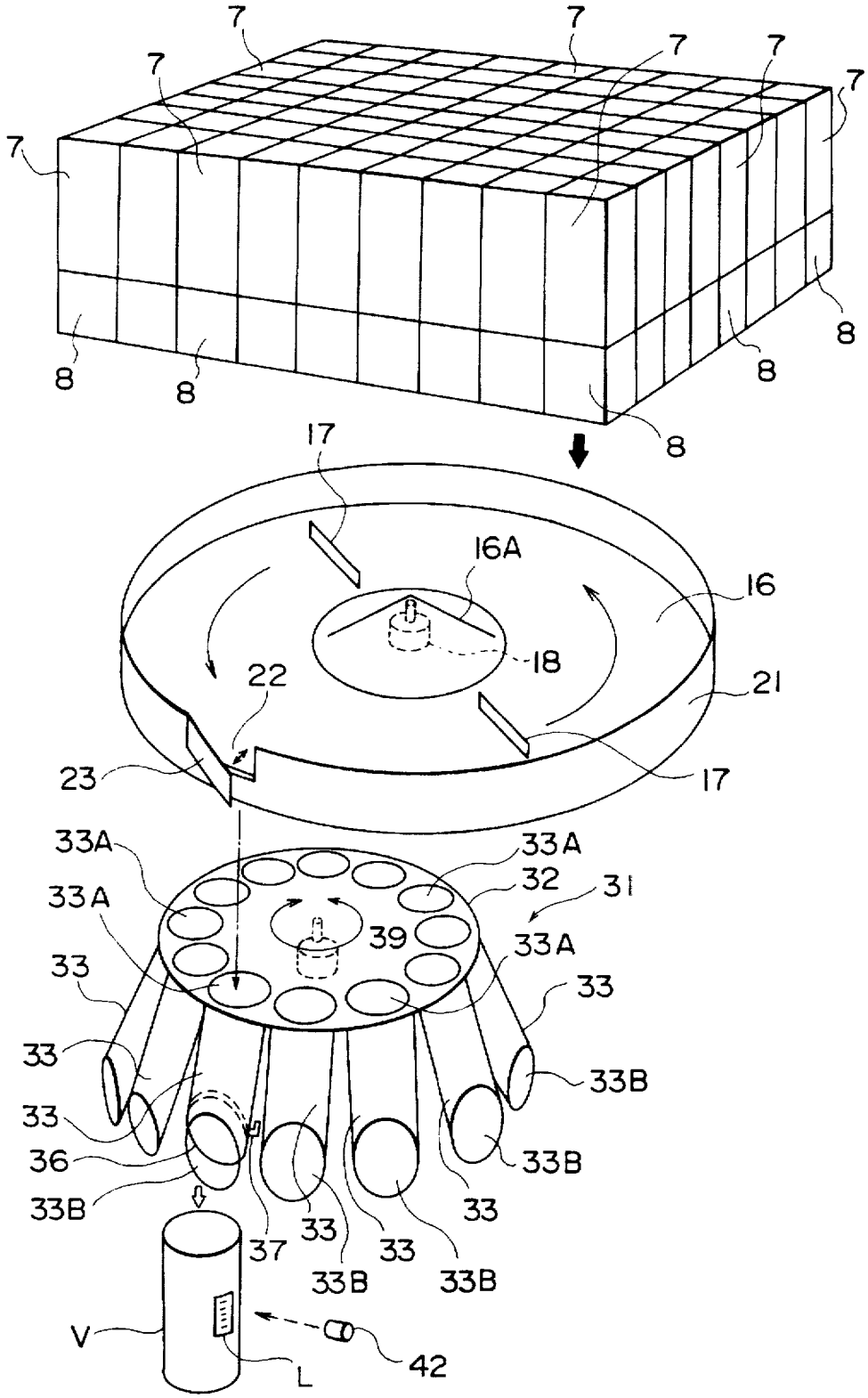
FIG. 5 is an explanatory view showing the internal configuration of the medication filling apparatus in accordance with the present invention.

Further, the respective holders 33 extend radially from the center of the base 32; the respective inlets 33A and the outlets 33B are arranged on virtual circles which are concentric with the base 32. The respective holders 33 are provided with covers 36 for opening and closing the respective outlets 33B (only one cover is shown in FIG. 5 and FIG. 6); and the covers 36 normally close the outlets 33B by springs or the like which are not shown. Each of the covers 36 has a handle 37 sticking out of the holder 33 and the cover 36 is swung by the handle 37 to open the outlet 33B.

A rotary shaft 38 juts out downward from the center of the base 32 of the holder unit 31. A holder motor 39 is attached to the rotary shaft 38 and the holder unit 31 is driven and rotated by the holder motor 39. The holder unit 31 is equipped with a holder position detecting sensor 41 for detecting the positions of the respective holders 33, which will be discussed hereinafter.

Inside the filling section 3B of the aforesaid outer case 3, there is provided a bar code reader 42 which is located near the outlet 6. Provided on the top surface of the filling section 3B are a key switch 43 consisting of ten keys and a display unit 47 for showing preparing states including prescription data and for giving an alarm.

Figure 9:
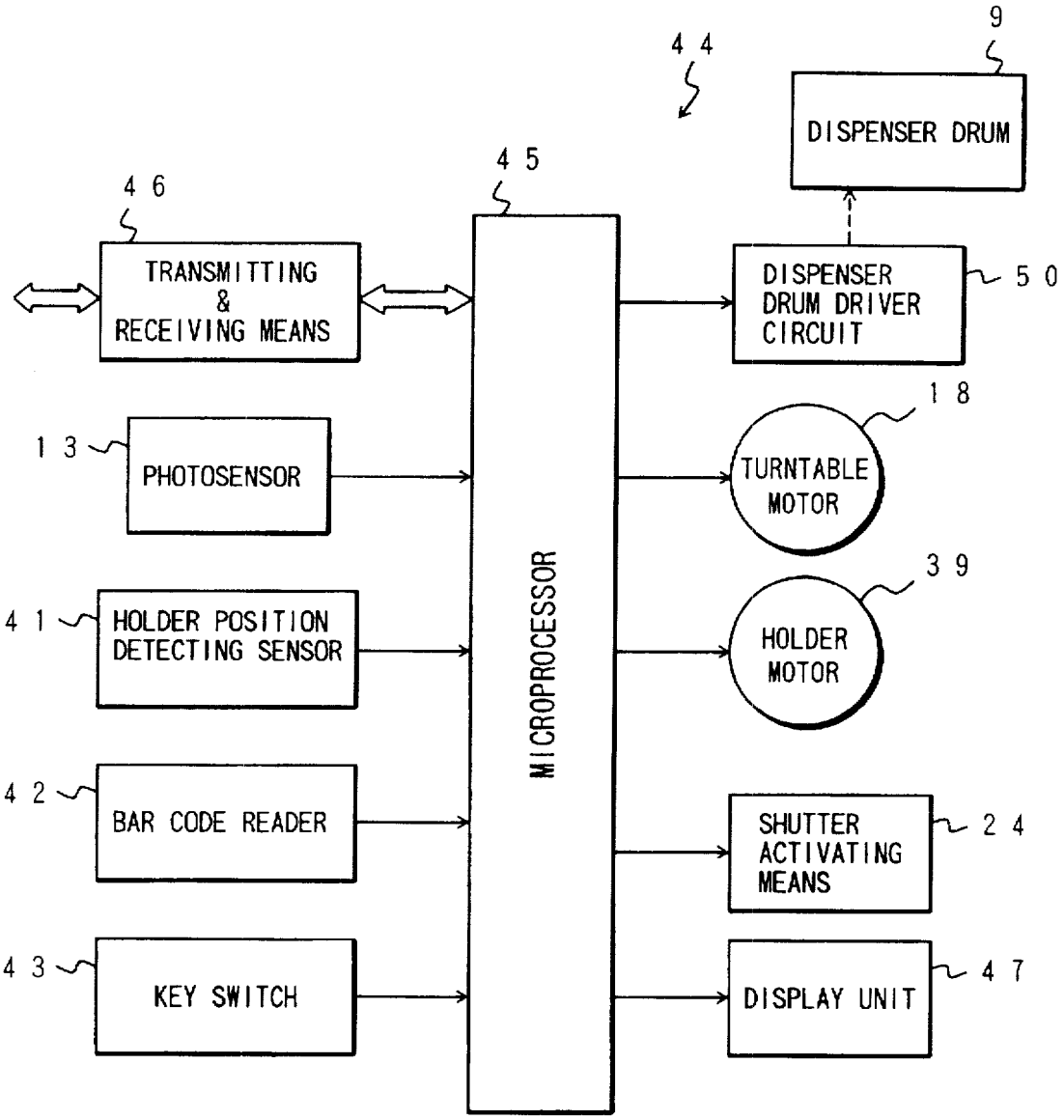
FIG. 9 is a block diagram showing a controller of the medication filling apparatus in accordance with the present invention.

FIG. 9 is the block diagram showing a controller 44 of the medication filling apparatus 1 in accordance with the present invention. The controller 44 is comprised of a general-purpose microprocessor 45. Connected to the microprocessor 45 is a transmitting and receiving means 46 for exchanging data with an external personal computer, which is not shown; connected to the input terminal thereof are the photosensors 13 of the dispensing and counting devices 8, the holder position detecting sensor 41 of the holder unit 31, the bar code reader 42, and the key switch 43. Connected to the output terminal of the microprocessor 45 are a dispenser drum driving circuit 50 of the dispensing and counting devices 8, the turntable motor 18, the holder motor 39, the shutter activating means 24, and the display unit 47.

Figure 12:
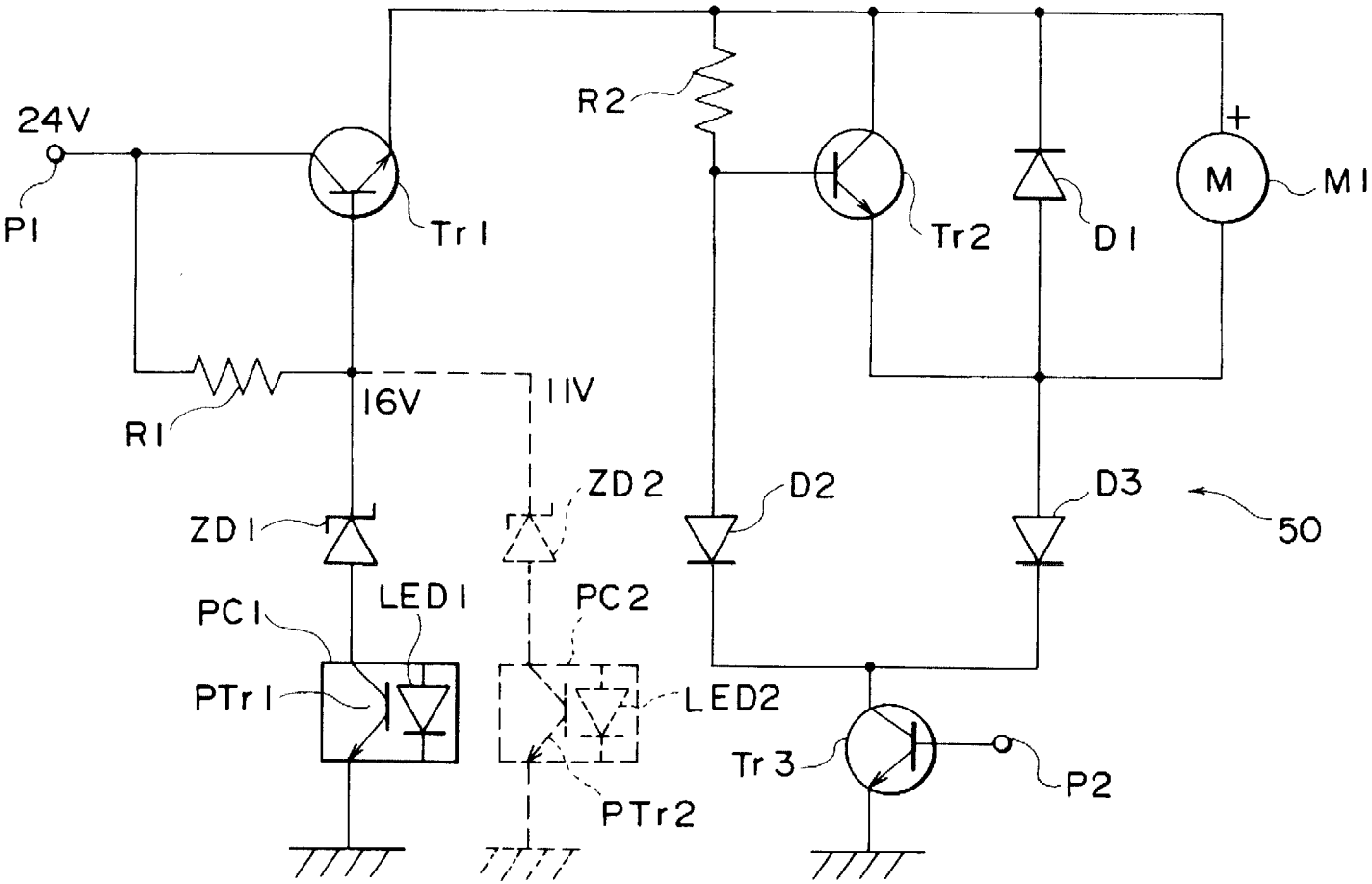
FIG. 12 is an electric circuit diagram of the dispenser drum driving circuit of the dispensing and counting device.

The dispenser drum driving circuit 50 is a control circuit for controlling the motor M1 for driving the dispenser drum 9. The details of the dispenser drum driving circuit 50 are shown in FIG. 12. The collector of a transistor Tr1 is connected to a 24VDC power supply P1; a resistor R1 is connected between the collector and the base of the transistor Tr1. Connected to the base of the transistor Tr1 is a Zener diode ZD1 for controlling the potential level of the connection terminal to 16 V. A phototransistor PTr1 of a photocoupler PC1, which is comprised of the phototransistor PTr1 and a light emitting diode LED1, is connected between the Zener diode ZD1 and the ground. The light emitting diode LED1 of the photocoupler PC1 is connected to the output terminal of the microprocessor 45.

Connected to the emitter of the transistor Tr1 is a series circuit composed of a resistor R2 and a diode D2; the series circuit is connected to the collector of a transistor Tr3. The emitter of the transistor Tr3 is grounded while the base thereof is connected to a terminal P2 which is connected to the output terminal of the microprocessor 45. A series circuit composed of the motor M1 and a diode D3 is connected between the emitter of the transistor Tr1 and the collector of the transistor Tr3. Connected across the terminals of the motor M1 are the collector and emitter of the transistor Tr2. The base of the transistor Tr2 is connected between the resistor R2 and the diode D2; the diode D1 is connected across the terminals of the motor M1.

The conducting direction of the diodes D2 and D3 is toward the transistor Tr3; for the diode D1, the conducting direction is toward the collector of the transistor Tr2. It is assumed that the dispenser drum driving circuit 50 is provided for the motor M1 of each dispenser drum 9.

Figure 10:
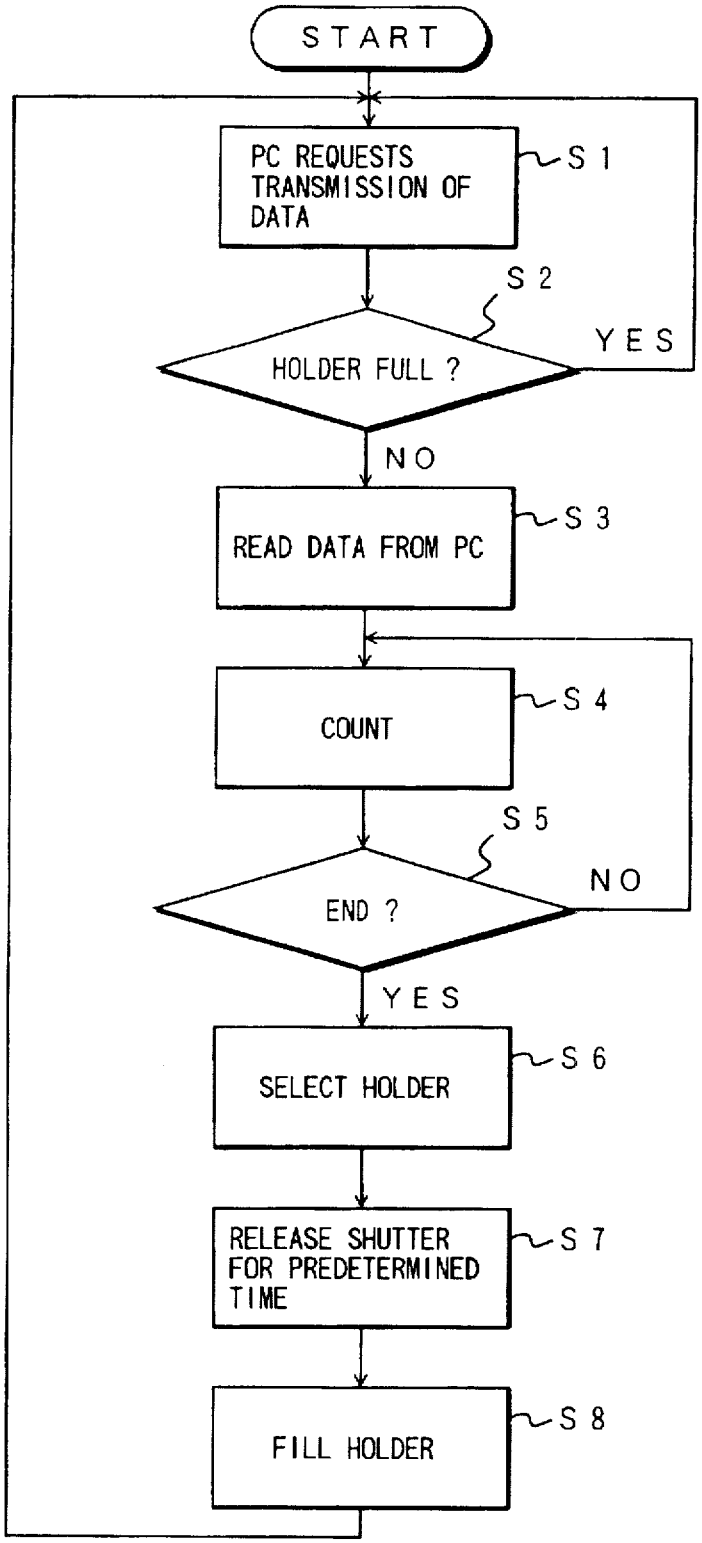
FIG. 10 is a flowchart showing a program of a microprocessor.
Figure 11:
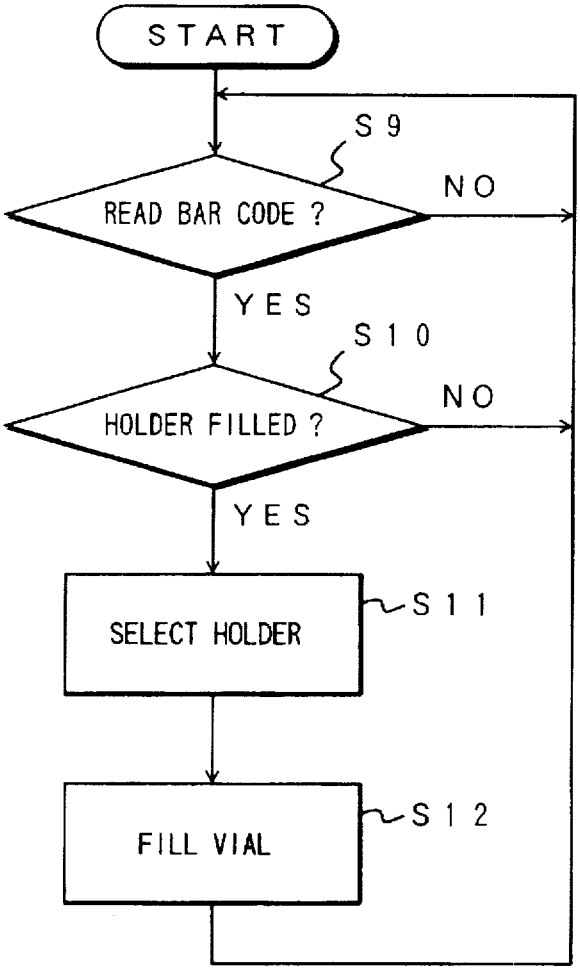
FIG. 11 is another flowchart showing the program of the microprocessor.

The operation of the medication filling apparatus 1 which has the configuration described above will now be described. FIG. 10 shows a flowchart of the program for the microprocessor 45 to perform the medication dispensing operation; FIG. 11 shows another flowchart of the program for the microprocessor 45 to perform the medication charging operation. When the power is ON, the shutter 23 closes the dispensing port 22 of the guide 21 and the count value is reset. Electric currents are supplied to the turntable motor 18 at all times to drive the turntable 16 at all times. The turntable 16 may be temporarily halted when the preparing operation is interrupted for a predetermined time.

When an operator keys in prescription data to the personal computer according to a prescription given by a doctor, the personal computer requests the transmission of data from the medication filling apparatus 1. As soon as the microprocessor 45 of the medication filling apparatus 1 receives the request for the data transmission from the personal computer through the transmitting and receiving means 46 in step S1, it determines in step S2 whether all the holders 33 of the holder unit 31 retain and are full of medications; if it decides that they are full, then it goes back to step S1 wherein it stands by.

If the microprocessor decides in step S2 that the holders 33 are not filled up, then it responds, in step S3, to the personal computer, telling that it is ready to receive data and it receives and reads the prescription data sent from the personal computer. In step S4, based on the prescription data, the microprocessor 45 drives and rotates the dispenser drum 9 of the dispensing and counting device 8 of the tablet case 7 which holds the type of medication specified in the prescription data.

In this case, the microprocessor 45 first supplies electric currents to the terminal P2 with the phototransistor PTr1

OFF, without supplying any electric currents to the light emitting diode ED1 of the photocoupler PC1 so as to turn ON the transistor Tr3. This causes electric currents to flow through the transistor Tr1, the motor M1, the diode D3, and the transistor Tr3 in the order in which they are listed and also causes a voltage of 24V to be applied to the motor M1 which runs at full speed. At this time, the transistor Tr2 is OFF because the voltage applied to the base thereof is dropped to a grounding potential level.

Figure 13:
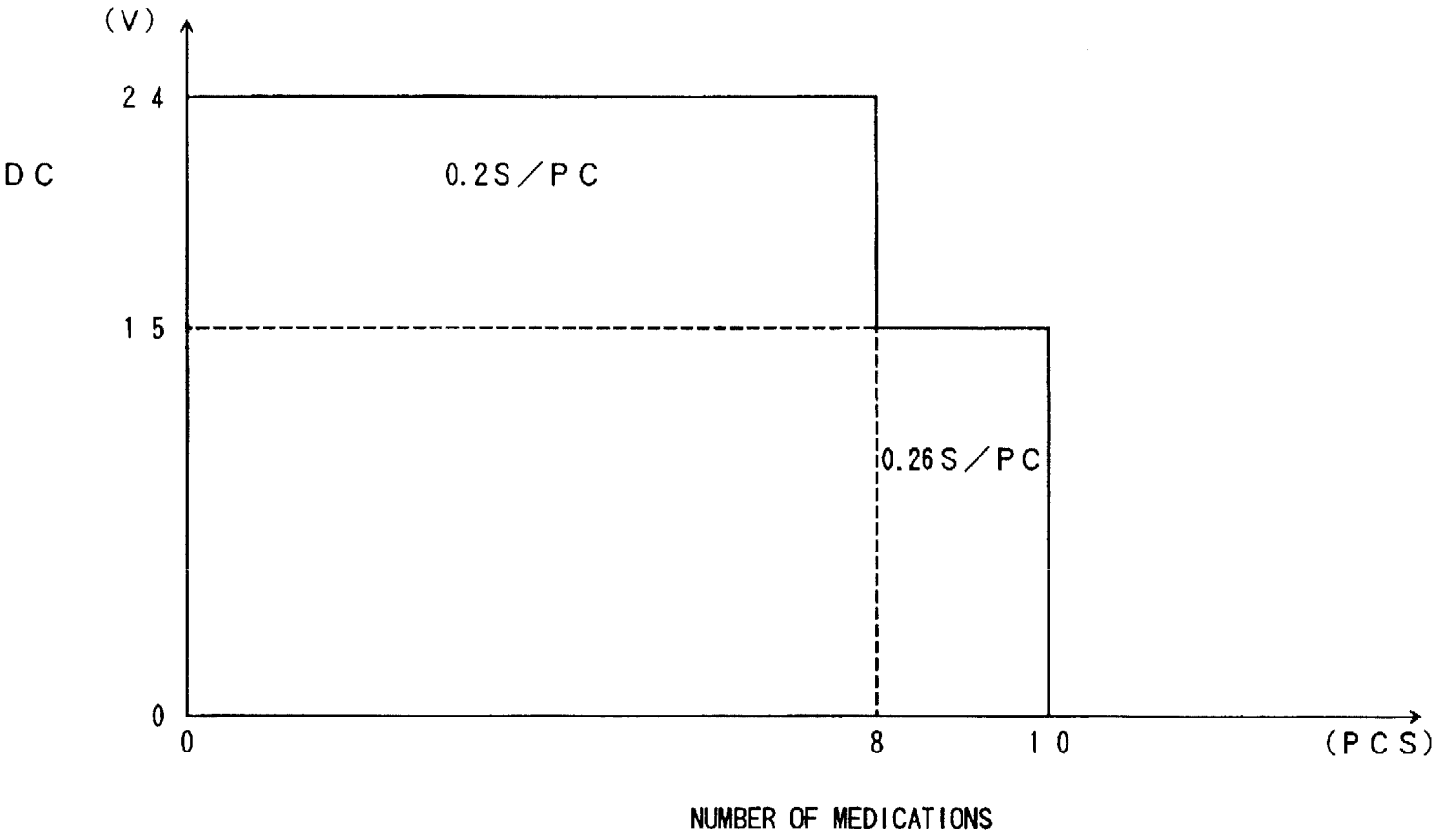
FIG. 13 is a diagram illustrative of a relationship between the number of medications dispensed and the voltage applied to the motor for driving the dispenser drum.

As the dispenser drum 9, which is driven by the motor M1, rotates, the medications drop one by one as previously mentioned; the dispensing speed is 0.2 sec/pc as illustrated in FIG. 13. The dropped medications are received by the turntable 16. The released medications are counted by the microprocessor 45 through the photosensor 13. In step S5, the microprocessor determines whether the counting has been completed; if the determination result is negative, then it goes back to step S4 to repeat the same process.

In the course of repeating the process, when a value (8 in this embodiment) before reaching the number of medications (10 in this embodiment) specified in the prescription data is reached, the microprocessor 45 supplies electric currents to the light emitting diode LED1 of the photocoupler PC1 to turn ON the phototransistor PTr1. This limits the voltage appearing at the emitter of the transistor Tr1 to 15 volts by the Zener diode ZD1, thus reducing the speed of the revolting motor M1 so that the dispensing speed is reduced to 0.26 sec/pc.

As soon as the number of dropped medications detected by the photosensor 13 reaches the specified number of medications, namely, ten, based on the prescription data, the microprocessor 45 stops the output to the terminal P2 and turns OFF the transistor Tr3. This stops the supply of electric currents to the motor M1, while at the same time turns ON the transistor Tr2 to short-circuit both terminals of the motor M1 through the transistor Tr2. Thus, back electromotive force produced by the overrun of the motor M1 is consumed by the coils, etc., enabling the motor M1 to make a sudden stop immediately when braking is engaged.

The microprocessor 45 then advances from step S5 to step S6 shown in FIG. 10.

The medications which have dropped onto the turntable 16 move toward the guide 21 located on the circumference of the turntable 16 due to the centrifugal force of the turntable 16. At this time, since the projecting cone 16A is located at the center of the turntable 16 at which the centrifugal force is weaker, the medications dropped onto the center move outward along the slope of the projecting cone 16A and then move toward the guide 21 owing to the centrifugal force. The partitioning vanes 17, 17 provided on the turntable 16 turn with the turntable, so that the medications which stay stationary on the turntable 16 may be also pushed and moved outside smoothly. Thus the medications dropped onto the turntable 16 are collected and moved to the guide 21 and aligned, being pushed against the guide 21.

Next, in step S6, the microprocessor 45 selects an empty holder 33, drives the holder motor 39 to rotate the holder unit 31, and positions the empty holder 33 under the dispensing port 22 of the guide 21 with the aid of the holder position detecting sensor 41. Then in step S7, the microprocessor 45 swings the shutter 23 outward as shown in FIG. 5 by the shutter activating means 24 to release the dispensing port 22 for a predetermined time (e.g. 1 second) and then close it.

When the dispensing port 22 is released, the medications aligned against the inner circumferential wall of the guide 21 are collected at the dispensing port 22 one after another by the centrifugal force and moved into the holder 33 through the inlet 33A of the holder 33 located below (step S8).

The microprocessor 45 repeats the procedure from step S4 to step S8 for all types of medications specified in the prescription data to fill the separate holders 33 with different medications.

The operator attaches a bar code label L, which carries the bar code indicating a patient identification code showing the name of the patient, a patient code, etc., the type name of the medications, and the quantity of the medications specified in the prescription data, to the side face of a vial V serving as the predetermined container. When the container is inserted into the filling section 3B through the inserting opening 6 of the medication filling apparatus 1, the bar code on the bar code label L is read through the bar code reader 42. The microprocessor 45 determines in step S9 shown in FIG. 11 whether the bar code carrying the identification information such as the type of medication has been successfully read through the bar code reader 42; if it decides that the bar code has been read properly, then it proceeds to step S10 wherein it decides whether the holder 33 has been filled with the specified type of medication. If the microprocessor finds that the holder has not yet been filled, then the microprocessor returns to step S9 wherein it stands by.

When the specified type of medications are charged in the holder 33 in step S8, the microprocessor 45 advances from step S10 to step S11 wherein it selects the holder 33 filled with the medications, drives the holder motor 39 to rotate the holder unit 31, and positions the holder 33 at the inserting opening 6 with the aid of the holder position detecting sensor 41.

Under the condition stated above, the port of vial V is positioned under the outlet 33B of the holder 33 and the cover 36 is opened by the handle 37 to fill the vial V with the specified type of medications from the holder 33 (step S12).

Thus, according to the present invention, dispensed medications are counted according to the outputs supplied by the photosensor 13; the moment the number of dispensed medications reaches 8 before the predetermined count value, namely, 10, is reaches, the voltage applied to the motor M1 for driving the dispenser drum 9 is lowered from 24 volts to 15 volts to decrease the running speed thereof; and when the predetermined count value is reached, the terminals of the motor M1 are short-circuited to eliminate the back electromotive force of the motor M1. Therefore, even when the running speed of the dispenser drum 9 is increased at an early stage to increase the medication dispensing speed, the overrun of the dispenser drum 9 can be controlled to prevent over-dispensing of the medications, thus assuring accurate medication filling.

In the embodiment described above, the voltage applied to the motor M1 is controlled in two steps. The voltage, however, may alternatively be controlled in three steps as described hereinafter. As indicated by dashed lines in FIG. 12, a Zener diode ZD2 for controlling the connection terminal to 11 volts may be connected to the base of the transistor Tr1; and the phototransistor PTr2 of the photocoupler PC2 composed of the phototransistor PTr2 and the light emitting diode LED2 is connected between the Zener diode ZD2 and the ground. By controlling the light emitting diode LED2 of the photocoupler PC2 by the microprocessor 45, the voltage applied to the motor M1 may be dropped to 15 volts when the count value reaches 6, then the light emitting diode LED2 is energized when the count value reaches 8 so as to drop the applied voltage further to 10 volts before the motor M1 is finally short-circuited.

As detailedly described above, according to the present invention, the voltage applied to the motor for driving the dispenser drum is dropped to reduce the motor running speed at a count value before reaching the predetermined count value. Further, when the predetermined count value is reached, the terminals of the motor are short-circuited so as to make the motor stop suddenly. With this arrangement, according to the present invention, the overrun of the dispenser drum can be effectively controlled, so that the over-dispensing of medications from a tablet case can be securely or effectively prevented, thereby enabling accurate filling operation to be achieved.

What is claimed is:

1. A medication filling apparatus comprising:

a tablet case for holding a plurality of medications;

a dispenser drum for dispensing the medications one at a time from said tablet case as it rotates;

a motor for driving and rotating said dispenser drum;

a sensor for detecting each of the medications which has been dispensed; and a controller which starts said motor, counts the dispensed medications according to an output of said sensor and produces a count value, and stops said motor when a predetermined count value is reached; wherein said controller decreases the voltage applied to said motor to reduce its speed of rotating said drum at a count value less than said predetermined count value.

2. A medication filling apparatus according to claim 1, wherein said controller decreases the voltage applied to said motor in steps when a count value less than said predetermined count value is reached.

3. A medication filling apparatus comprising:

a tablet case for holding a plurality of medications;

a dispenser drum for dispensing the medications one at a time from said tablet case as it rotates;

a motor for driving and rotating said dispenser drum;

a sensor for detecting each of the medications which have been dispensed; and a controller which starts said motor, counts the dispensed medications according to an output of said sensor and produces a count value, and stops said motor when a predetermined count value is reached; wherein said controller decreases the voltage applied to said motor when a count value less than said predetermined count value is reached and then short-circuits the terminals of said motor when said predetermined count value is reached.

4. A medication filling apparatus according to claim 3, wherein said controller decreases the voltage applied to said motor in steps when a count value less than said predetermined count value is reached.

* * * * *